US009677406B2

(12) United States Patent
Hirata et al.

(10) Patent No.: US 9,677,406 B2
(45) Date of Patent: Jun. 13, 2017

(54) ROTOR BLADE SUPPORT STRUCTURE

(71) Applicant: MITSUBISHI HITACHI POWER SYSTEMS, LTD., Yokohama-shi, Kanagawa (JP)

(72) Inventors: Tomoyuki Hirata, Tokyo (JP); Eigo Katou, Tokyo (JP); Hidekatsu Atsumi, Tokyo (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 520 days.

(21) Appl. No.: 14/241,819

(22) PCT Filed: Oct. 16, 2012

(86) PCT No.: PCT/JP2012/076650
§ 371 (c)(1),
(2) Date: Feb. 27, 2014

(87) PCT Pub. No.: WO2013/058220
PCT Pub. Date: Apr. 25, 2013

(65) Prior Publication Data

US 2014/0219806 A1 Aug. 7, 2014

(30) Foreign Application Priority Data

Oct. 20, 2011 (JP) ..... 2011-230293

(51) Int. Cl.
*F01D 5/30* (2006.01)

(52) U.S. Cl.
CPC ..... *F01D 5/3007* (2013.01); *F05D 2260/941* (2013.01)

(58) Field of Classification Search
CPC ... F01D 5/02; F01D 5/021; F01D 5/06; F01D 5/00; F01D 5/3007; F05D 2260/941
See application file for complete search history.

(56) References Cited

U.S. PATENT DOCUMENTS 2,751,189 A * 6/1956 Ledwith ..... F01D 5/3007 416/193 A
3,055,633 A * 9/1962 Pouit ..... F01D 5/021 416/193 A (Continued)

FOREIGN PATENT DOCUMENTS

CN 102121400 A 7/2011
DE 1051286 B2 2/1959

(Continued)

OTHER PUBLICATIONS

Notification of Transmittal of Translation of the International Preliminary Report on Patentability (Forms PCT/IB/338) of International Application No. PCT/JP2012/076650 mailed May 1, 2014 with Forms PCT/IB/373 and PCT/ISA/237 (8 pages).
International Search Report of PCT/JP2012/076650, mailing date of Nov. 20, 2012.
Extended European Search Report dated Apr. 7, 2015, issued in corresponding application No. 12841543.7 (5 pages).

(Continued)

*Primary Examiner* — Jason L Vaughan
(74) *Attorney, Agent, or Firm* — Westerman, Hattori, Daniels & Adrian, LLP

(57) ABSTRACT

The purpose of the invention is to provide a rotor blade support structure, wherein the concentration of stress near the rotor blade groove in which the rotor blade is embedded is limited even as increase in production cost is limited. A rotor blade support structure, in which rotor blades (30) are embedded in rotor blade grooves (10) provided on a rotor disc (1), wherein the rotor blade groove (10) is provided with circular direction grooves (13) that extend more in the circular direction of the rotor disc than upward from the bottom (14), and shaft center direction grooves (15) that are provided on the end faces (1*a*, 1*b*) of the rotor disc (1) in the center of the bottom (14) in the circular direction of the rotor disc and that extend towards the rotor disc shaft center.

6 Claims, 7 Drawing Sheets

(56) References Cited

U.S. PATENT DOCUMENTS

| | | | | |
|---|---|---|---|---|
| 4,022,545 | A * | 5/1977 | Shank | F01D 5/3007 416/135 |
| 7,794,207 | B2 * | 9/2010 | Bacciottini | F01D 5/06 416/219 R |
| 8,167,566 | B2 * | 5/2012 | Howes | F01D 5/3007 416/219 R |
| 8,708,656 | B2 * | 4/2014 | Barnett | F01D 5/3007 416/204 A |
| 8,764,402 | B2 * | 7/2014 | Agaram | F01D 5/3007 416/220 R |
| 8,959,738 | B2 * | 2/2015 | Hathiwala | B23P 6/005 29/281.1 |
| 8,992,180 | B2 * | 3/2015 | Agaram | F01D 5/30 416/221 |
| 9,359,905 | B2 * | 6/2016 | Lamicq | F01D 5/3007 |
| 2004/0115056 | A1 | 6/2004 | Pierre | |
| 2006/0266050 | A1 | 11/2006 | Stevens et al. | |
| 2008/0063529 | A1 | 3/2008 | Miller et al. | |
| 2013/0195668 | A1 * | 8/2013 | Milne | F01D 5/005 416/217 |

FOREIGN PATENT DOCUMENTS

| | | | |
|---|---|---|---|
| EP | 0 478 234 | A1 | 4/1992 |
| EP | 1 048 821 | A2 | 11/2000 |
| EP | 1 726 784 | A2 | 11/2006 |
| GB | 643914 | A | 9/1950 |
| JP | 59-97207 | U | 7/1984 |
| JP | 62-061761 | B2 | 12/1987 |
| JP | 11-182494 | A | 7/1999 |
| JP | 2000-337294 | A | 12/2000 |
| JP | 2006-329203 | A | 12/2006 |
| JP | 2008-069781 | A | 3/2008 |
| JP | 2011-012568 | A | 1/2011 |

OTHER PUBLICATIONS

Chinese Office Action dated Dec. 29, 2014, issued in Chinese Application No. 201280041695.7, w/English translation. (15 pages).

* cited by examiner

ROTOR BLADE SUPPORT STRUCTURE

TECHNICAL FIELD

The present invention relates to a rotor blade support structure and, to be more specific, relates to a rotor blade support structure wherein stress concentration in a rotor blade groove in which a rotor blade is embedded is reduced.

BACKGROUND ART

Industrial turbines and steam turbines each include a casing and a rotor rotatably supported by the casing. The turbine has a structure in which rotor discs are installed in the rotor in multiple stages in a rotor axial direction and rotor blades are embedded respectively in multiple rotor blade grooves provided in a peripheral surface of each rotor disc.

Here, description is given of the rotor blade groove with reference to FIG. 9A which is a perspective view showing a main portion of the rotor disc in a conventional rotor blade support structure in an enlarged manner. As shown in FIG. 9A, a rotor blade groove 110 penetrating one end surface portion 101*b* and the other end surface portion (not illustrated) opposite to the one end surface portion 101*b* is provided in a peripheral surface of the rotor 101. The rotor blade groove 110 includes circumferential groove portions 112, 112 in a bottom portion 113 of the rotor blade groove 110. The circumferential groove portions 112, 112 have arc-shaped ends and extend in a rotor circumferential direction beyond a portion above the bottom portion 113.

PRIOR ART DOCUMENT

Patent Documents

Patent Document 1: Japanese Patent Application Publication No. 2008-069781

Patent Document 2: Japanese Examined Patent Application Publication No. Sho 62-061761

SUMMARY OF THE INVENTION

Problem to be Solved by the Invention

In the turbine described above, a temperature difference between the inside and the outside of the rotor disc increases in, for example, startup and shutdown. Thus, stress concentration occurs due to transient thermal stress near the circumferential groove portion of the rotor blade groove. For example, through a simulation of a stress concentration coefficient in a rotor disc having rotor blade grooves with the aforementioned shape, we have confirmed that, as shown in FIG. 9B, the stress concentrates near the circumferential groove portion of each rotor blade groove and the stress concentration coefficient Kt is 2.67 in this portion. Note that, in FIG. 9B, areas where the stress concentration coefficient is 1 are shown without hatching, and areas where the stress concentration coefficient is small are shown by hatching with large intervals between the lines. The smaller the intervals of lines of hatching become, the larger the stress concentration coefficient of the area indicated by that hatching is. When the stress concentration becomes more intense, low-cycle fatigue occurs, for example, near the circumferential groove portion of the rotor blade groove and the life of the turbine may be reduced. To counter such a problem, the stress concentration can be alleviated by taking measures such as running the turbine with operations limited in such a way that the startup is performed slowly or in a similar way. However, as a turbine, there is a demand for a quick-start turbine which can be quickly started, and the turbine taking the aforementioned measures cannot be run to perform a quick start. Moreover, manufacturing the rotor disc by using a material with high strength is conceivable but this has a problem of an increase in manufacturing cost.

The present invention has been made to solve the problems described above and an object thereof is to provide a rotor blade support structure wherein stress concentration near a rotor blade groove in which a rotor blade is embedded is suppressed with an increase in manufacturing cost also being suppressed.

Means for Solving the Problem

A rotor blade support structure of the present invention which solves the problems described above is a rotor blade support structure in which a rotor blade is embedded in a rotor blade groove provided in a rotor disc, characterized in that the rotor blade groove includes:

a circumferential groove portion in a bottom portion of the rotor blade groove, the circumferential groove portion extending in a rotor disc circumferential direction beyond a portion above the bottom portion; and an axial groove portion which is provided in a center portion of the bottom portion in the rotor disc circumferential direction, in an end surface portion of the rotor disc and extends in a rotor disc axial direction.

A rotor blade support structure of the present invention which solves the problems described above is the aforementioned rotor blade support structure of the present invention characterized in that $w'/W$ is within a range of 0.49 to 1.0, where 2W represents a size of the bottom portion of the rotor blade groove in the rotor disc circumferential direction and 2*w*' represents the size of the axial groove portion in the rotor disc circumferential direction.

A rotor blade support structure of the present invention which solves the problems described above is the aforementioned rotor blade support structure of the present invention characterized in that an angle with respect to the bottom portion of the rotor blade groove in the axial groove portion is within a range of 20° to 50°.

A rotor blade support structure of the present invention which solves the problems described above is the aforementioned rotor blade support structure of the present invention characterized in that $d/w'$ is within a range of 1.0 to 1.4, where d represents a size of the axial groove portion in the rotor disc axial direction.

Effect of the Invention

In the rotor blade support structure of the present invention, the axial groove portion is provided in the center portion of the bottom portion of the rotor blade groove in the rotor disc circumferential direction, in the end surface portion of the rotor disc. This causes the stress concentration coefficient to be distributed to the circumferential groove portions and the axial groove portion in the rotor blade groove when transient thermal stress occurs. As a result, stress concentration in the circumferential groove portion in the rotor blade groove is suppressed. There is a need to only provide the axial groove portion in the rotor blade groove and an increase in manufacturing cost is thus suppressed.

MODES FOR CARRYING OUT THE INVENTION

Figure 1:
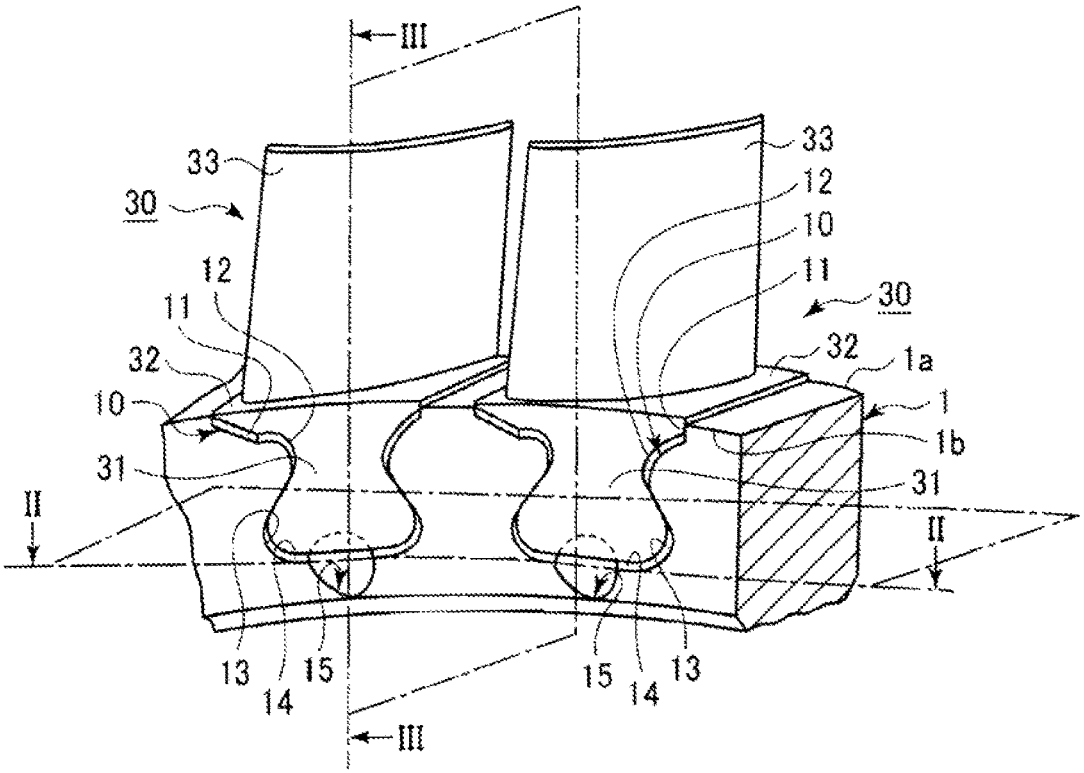
FIG. 1 is a view for explaining a rotor blade support structure in one embodiment of the present invention.
Figure 2:
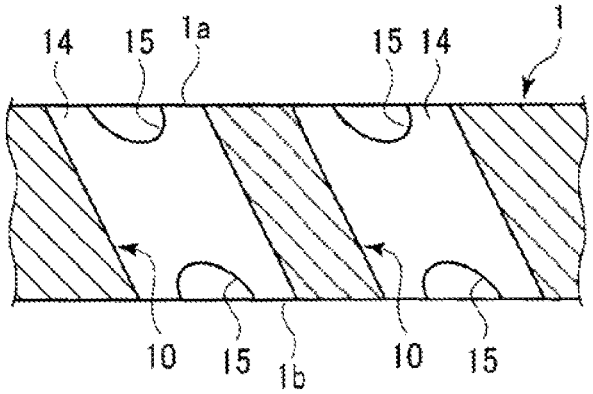
FIG. 2 is a cross sectional view taken along the II-II line in FIG. 1.

With reference to FIGS. 1 to 4, one embodiment of a rotor blade support structure of the present invention is described below.

As shown in FIGS. 1 to 4, in the rotor blade support structure of the embodiment, multiple (two in an illustrated example) rotor blade grooves 10 are provided in a peripheral surface of a rotor disc 1 and a rotor blade 30 is embedded in each of the rotor blade grooves 10. The rotor blade 30 includes a platform 32 provided with a blade root 31 and a blade portion 33 provided on the platform 32. Note that, in FIG. 1, the blade root 31 and the platform 32 of the rotor blade 30 are embedded in the rotor blade groove 10.

Each rotor blade groove 10 penetrates one end surface portion 1*b* of the rotor disc 1 and the other end surface portion 1*a* opposite to the one end surface portion 1*b* and extends in a direction inclined with respect to a circumferential direction of the rotor disc 1. The rotor blade groove 10 has a shape including a groove portion 11 along the platform 32 of the rotor blade 30 and a groove portion 12 along the blade root 31 of the rotor blade 30. The rotor blade groove 10 includes circumferential groove portions 13, 13 in a bottom portion 14 of the rotor blade groove 10 which have arc-shaped ends and which extend in the rotor disc circumferential direction beyond a portion above the bottom portion 14.

Figure 3:
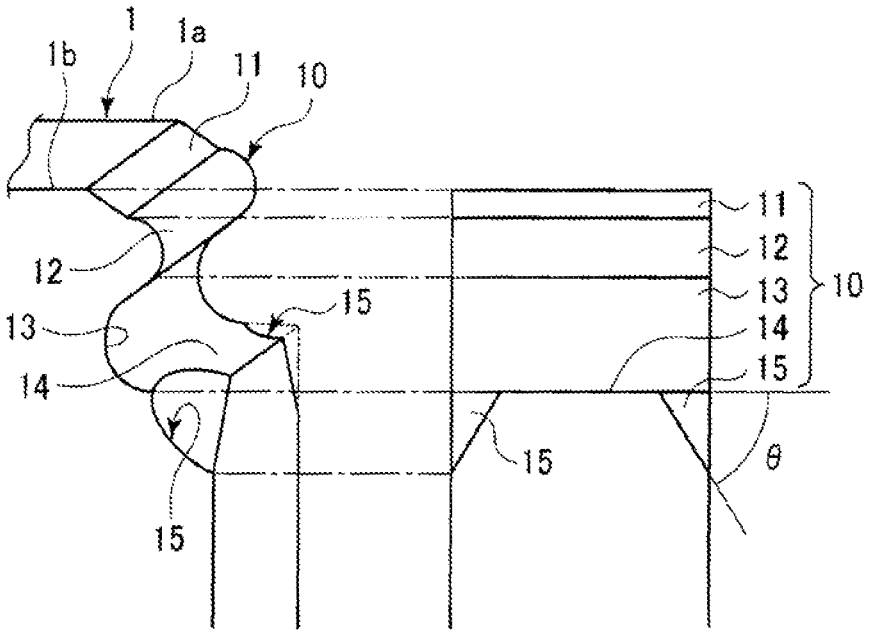
FIG. 3 includes views for explaining a cross section taken along the III-III line in FIG. 1 and a left view is a perspective view of the cross section while a right view is a cross-sectional view.

The rotor blade groove 10 described above further includes an axial groove portion (relief groove portion) 15 formed in a center portion of a bottom portion 14 in the rotor disc circumferential direction in each of the end surface portions 1*a*, 1*b* of the rotor disc 1. The axial groove portion 15 extends in an axial direction of the rotor disc 1 and has an arc-shaped end. Providing the axial groove portion 15 as described above has the following effect. Tensile stress in the rotor disc circumferential direction is generated in layers in the rotor disc 1 by transient thermal stress and a flow of the stress in the rotor disc circumferential direction which conventionally concentrates in the circumferential groove portion of the rotor blade groove is distributed to the circumferential groove portions 13, 13 and the axial groove portion 15 of the rotor blade groove 10 and is alleviated. Thus, the stress concentration in the circumferential groove portions 13, 13 in the rotor blade groove 10 can be suppressed. As shown in FIG. 3 (right view), a relief angle θ of the axial groove portion 15 refers to an extending direction of the axial groove portion 15 with respect to the bottom portion 14 of the rotor blade groove 10.

Figure 4:
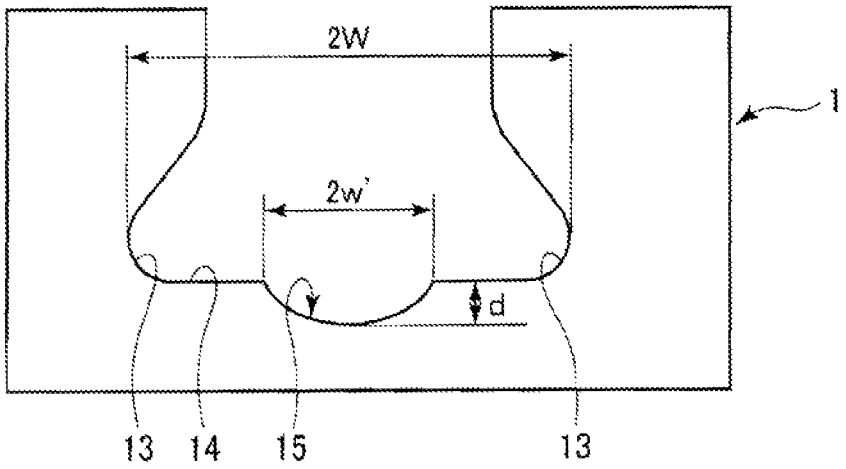
FIG. 4 is a view for explaining dimensions of a rotor blade groove in the rotor blade support structure in the one embodiment of the present invention.
Figure 5:
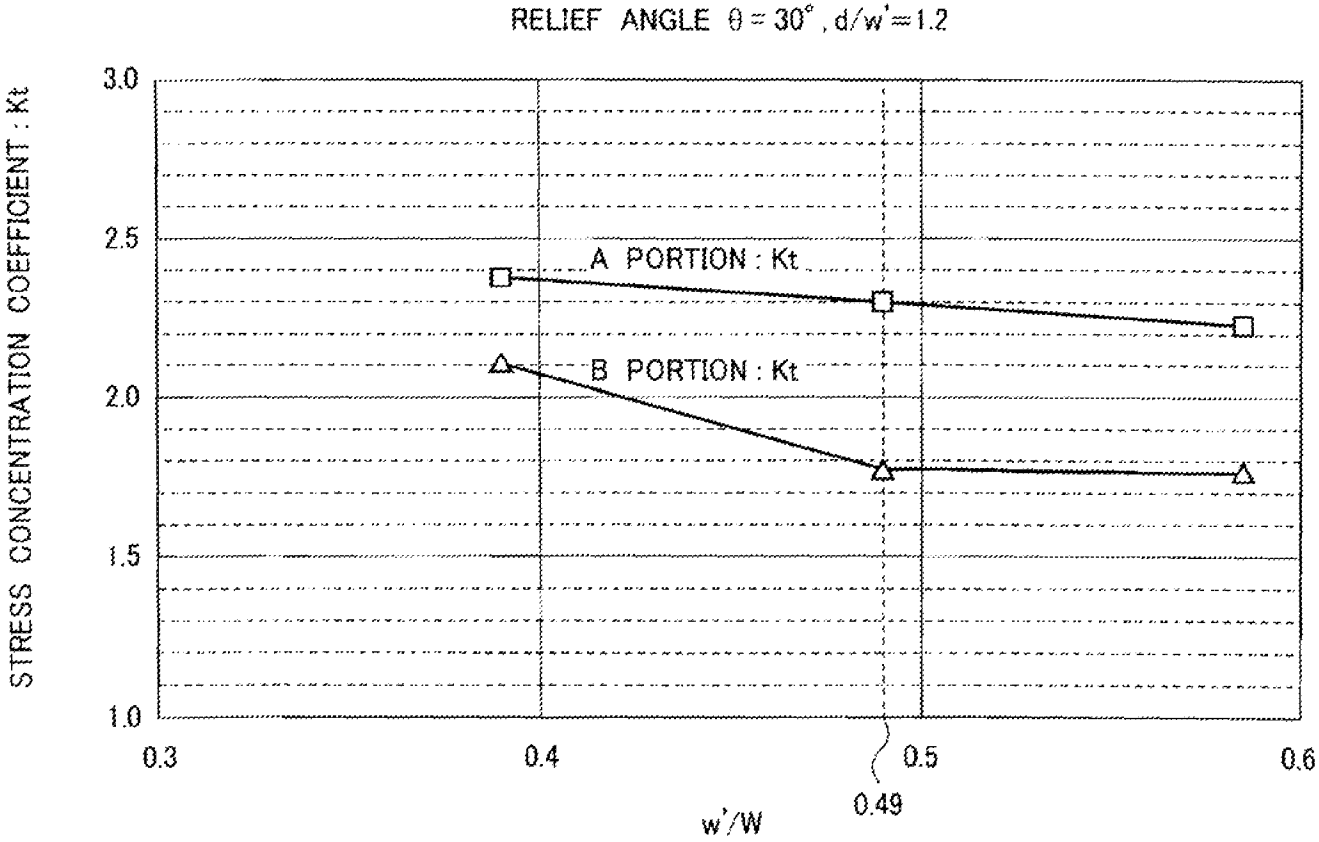
FIG. 5 is a graph showing a relationship between a stress concentration coefficient Kt and the size of an axial groove portion (relief groove portion) with respect to the rotor blade groove (w'/W) in the rotor blade support structure in the one embodiment of the present invention.

Here, with reference to FIGS. 5 and 4, description is given of a relationship between a stress concentration coefficient Kt and w'/W which is the size of the axial groove portion 15 with respect to the rotor blade groove 10, in a case where the relief angle θ is set to 30° and the size of the axial groove portion 15 in the axial direction with respect to the size thereof in the rotor disc circumferential direction (d/w') is set to 1.2 in the rotor blade support structure described above. Note that, in FIG. 5, white squares indicate the stress concentration coefficient Kt in an A portion (the circumferential groove portion of the rotor blade groove) and white triangles indicate the stress concentration coefficient Kt in a B portion (the axial groove portion of the rotor blade groove).

As shown in FIG. 5, it is confirmed that, in both of the A portion (the circumferential groove portion of the rotor blade groove) and the B portion (the axial groove portion of the rotor blade groove), the stress concentration coefficient Kt in a case where w'/W is 0.49 is smaller than that in a case where w'/W is slightly below 0.4. It is confirmed that the stress concentration coefficient Kt is substantially constant in the B portion (the axial groove portion of the rotor blade groove) when w'/W is set within a range of 0.49 to a value slightly below 0.6. Since the stress concentration coefficient Kt is constant in the B portion (the axial groove portion of the rotor blade groove) even if the size of the axial groove portion 15 is increased with respect to the rotor blade groove 10, the following point can be inferred. Even if the size of the axial groove portion 15 in the rotor disc circumferential direction is increased and is set to the same size as the size of the rotor blade groove 10 in the rotor disc circumferential direction to satisfy w'/W=1.0, the stress concentration coefficient Kt is substantially the same value as that in the case where the w'/W is set to 0.49.

It is thus confirmed that the stress generated by the transient thermal stress can be distributed to the circumferential groove portions 13, 13 and the axial groove portion 15 of the rotor blade groove 10 and be alleviated when the size of the axial groove portion 15 with respect to the rotor blade groove 10 (w'/W) is set within a range of 0.49 to 1.0.

Figure 6:
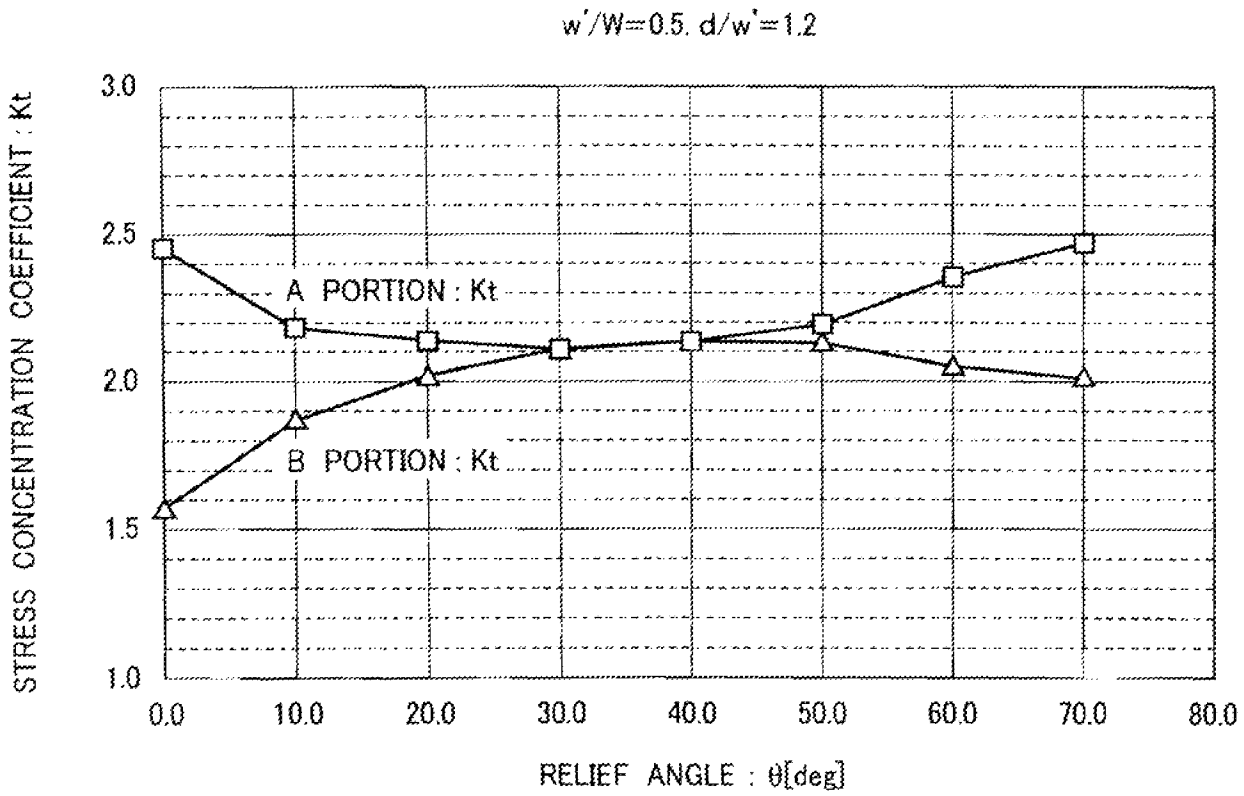
FIG. 6 is a graph showing a relationship between the stress concentration coefficient Kt and a relief angle of the axial groove portion (relief groove portion) in the rotor blade support structure in the one embodiment of the present invention.

With reference to FIGS. 4 and 6, description is given of a relationship between the relief angle θ of the axial groove portion and the stress concentration coefficient Kt in a case where w'/W is set to 0.5 and d/w' is set to 1.2 in the rotor blade support structure described above. Note that, in FIG. 6, white squares indicate the stress concentration coefficient Kt in the A portion (the circumferential groove portion of the rotor blade groove) and white triangles indicate the stress concentration coefficient Kt in the B portion (the axial groove portion of the rotor blade groove). Moreover, the stress concentration coefficients Kt in the A portion and the B portion are the same value when the relief angle is 30.0° and 40.0°.

As shown in FIG. 6, it is confirmed that the stress concentration coefficients Kt in the A portion (the circumferential groove portion of the rotor blade groove) and the B portion (the axial groove portion of the rotor blade groove) are substantially the same value when the relief angle is in the range of 20.0° or more and 50.0° or less.

It is thus confirmed that the stress generated by the transient thermal stress can be distributed to the circumferential groove portions 13, 13 and the axial groove portion 15 of the rotor blade groove 10 and be alleviated when the degree of the relief angle in the axial groove portion 15 is set within a range of 30.0° to 50.0°.

Figure 7:
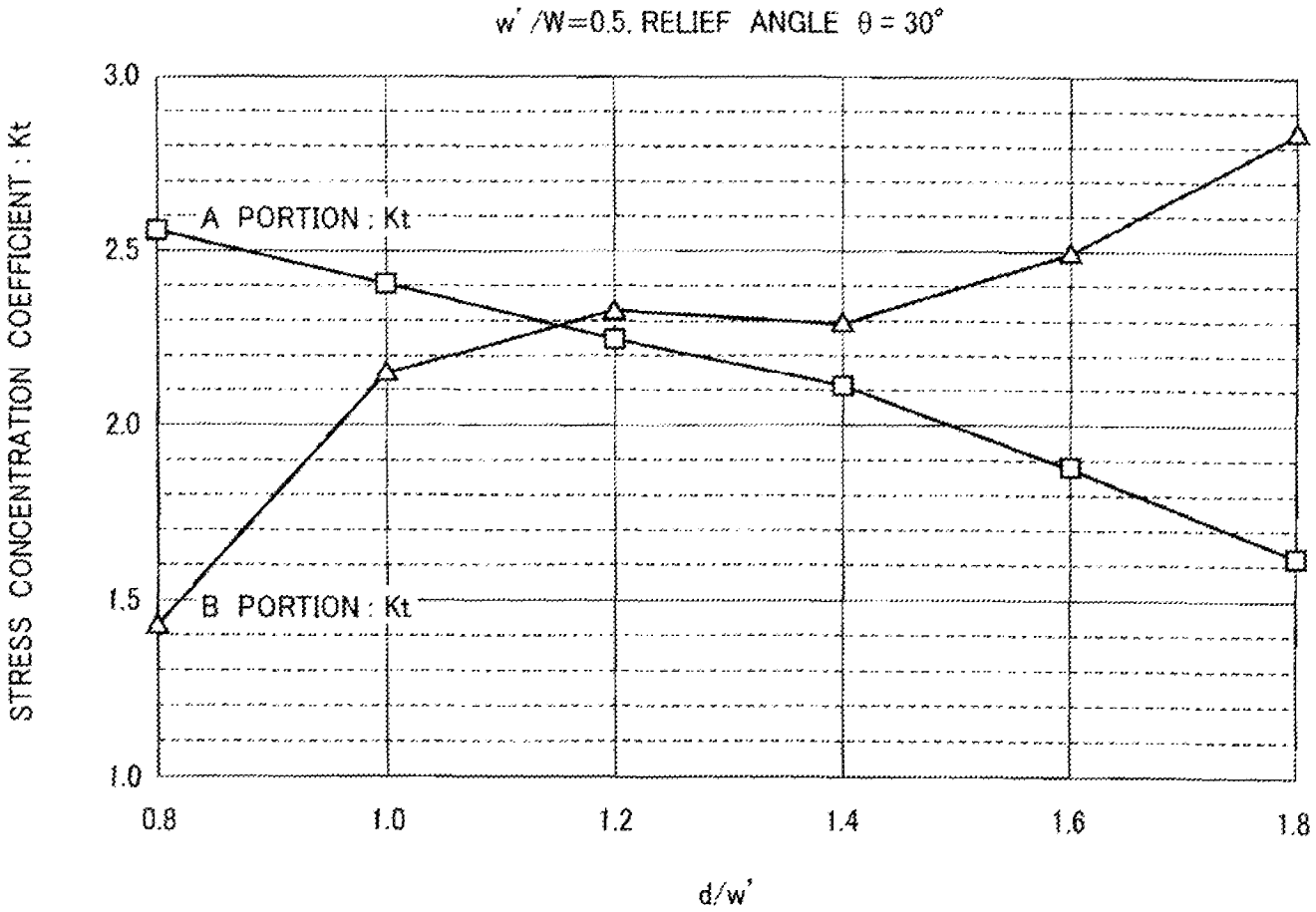
FIG. 7 is a graph showing a relationship between the stress concentration coefficient Kt and the size of the axial groove portion (relief groove portion) in the axial direction with respect to the size thereof in the rotor disc circumferential direction (d/w') in the rotor blade support structure in the one embodiment of the present invention.

With reference to FIGS. 4 and 7, description is given of a relationship between the stress concentration coefficient Kt and the size of the axial groove portion in the axial direction with respect to the size thereof in the rotor disc circumferential direction (d/w') in a case where w'/W is set to 0.5 and the relief angle θ is set to 30° in the rotor blade support structure described above. Note that, in FIG. 7, white squares indicate the stress concentration coefficient Kt in the A portion (the circumferential groove portion of the rotor blade groove) and white triangles indicate the stress concentration coefficient Kt in the B portion (the axial groove portion of the rotor blade groove).

As shown in FIG. 7, it is confirmed that the stress concentration coefficient Kt of the A portion (the circumferential groove portion of the rotor blade groove) and the stress concentration coefficient Kt of the B portion (the axial groove portion of the rotor blade groove) are substantially the same value when the size of the axial groove portion 15 in the axial direction with respect to the size thereof in the rotor disc circumferential direction (d/w') is set within a range of 1.0 to 1.4.

It is thus confirmed that the stress generated by the transient thermal stress can be distributed to the circumferential groove portions 13, 13 and the axial groove portion 15 of the rotor blade groove 10 and be alleviated when the size of the axial groove portion 15 in the axial direction with respect to the size thereof in the rotor disc circumferential direction (d/w') is set in a range of 1.0 to 1.4.

Figure 8:
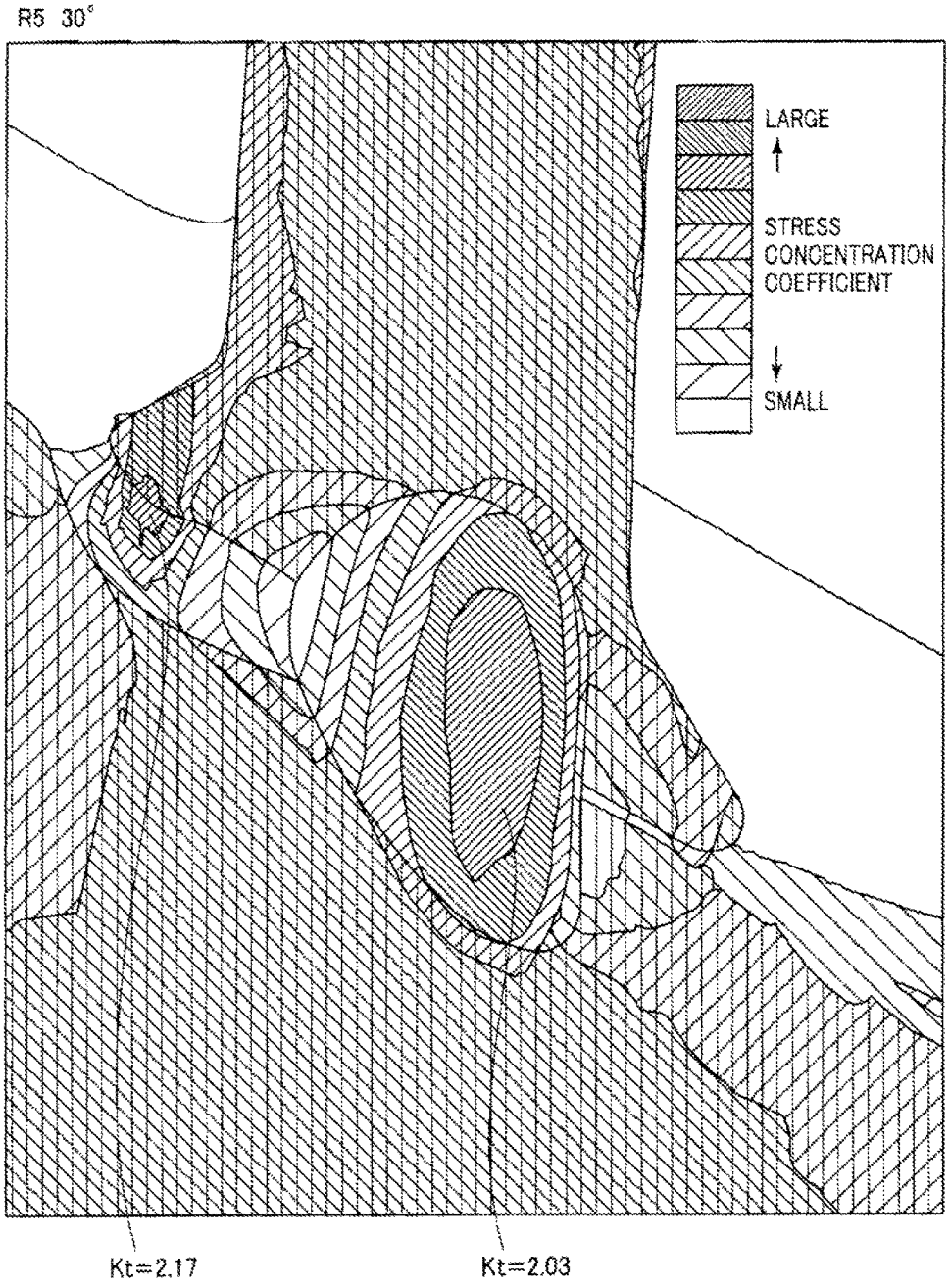
FIG. 8 is a view showing a simulation result of the stress concentration coefficient in a case where the relief angle of the axial groove portion (relief groove portion) is set to 30° in the rotor blade support structure in the one embodiment of the present invention.

Here, with reference to FIG. 8, description is given of a simulation result of the stress concentration coefficient in a case where the angle of the axial groove portion (relief groove portion) is set to 30° in the rotor blade support structure in which the rotor blade grooves having the shape described above are provided in the rotor disc. In FIG. 8, areas where the stress concentration coefficient is 1 are shown without hatching, and areas where the stress concentration coefficient is small are shown by hatching with large intervals between the lines. The smaller the intervals of lines of hatching become, the larger the stress concentration coefficient of the area indicated by that hatching is.

Figure 9A:
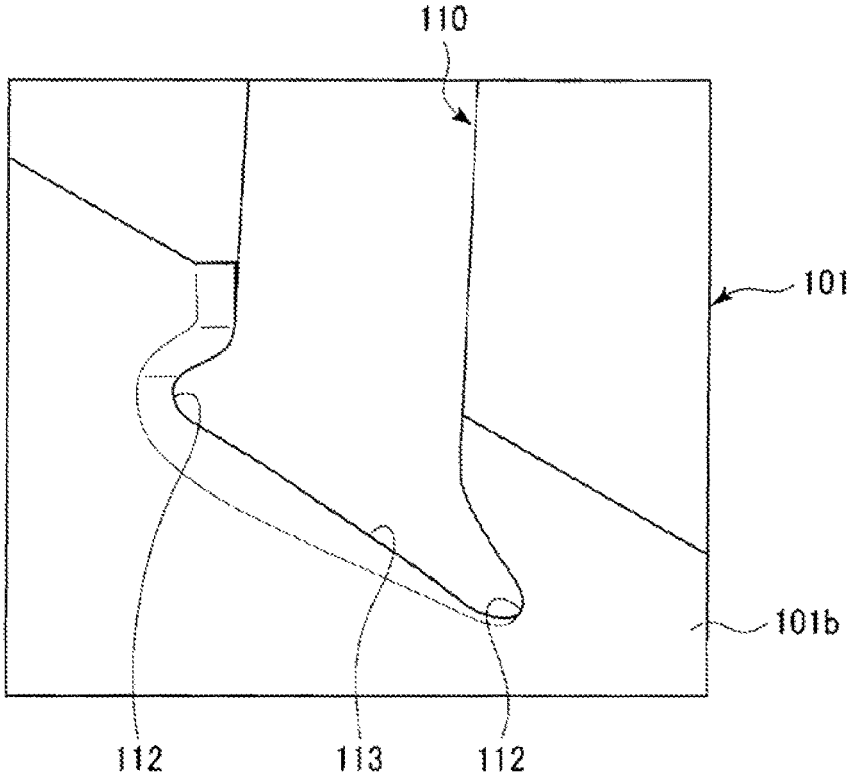
FIG. 9A is a view for explaining an example of a conventional rotor blade support structure and is a perspective view showing a main portion of a rotor disc of the conventional rotor blade support structure in an enlarged manner.
Figure 9B:
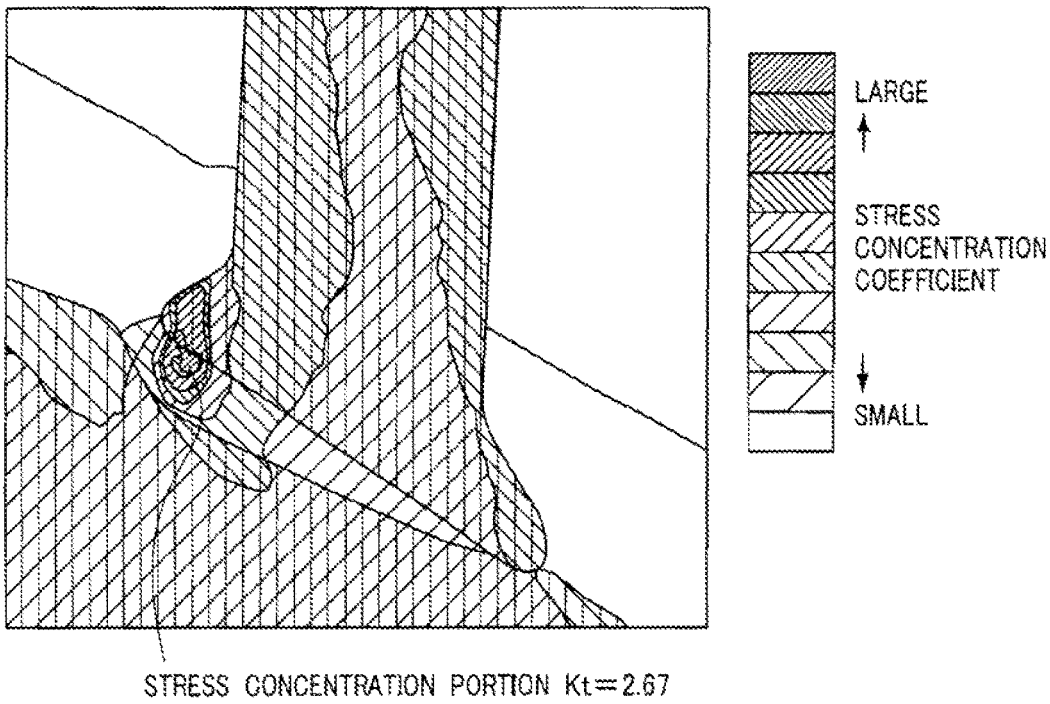
FIG. 9B is a view for explaining the example of the conventional rotor blade support structure and shows a simulation result of the stress concentration coefficient in the conventional rotor blade support structure.

As shown in FIG. 8, it is confirmed that the stress concentration coefficients Kt in the circumferential groove portion and the axial groove portion of the rotor blade groove are higher than those in other portions and the stress concentration coefficient Kt in the circumferential groove portion of the rotor blade groove is 2.17 while the stress concentration coefficient Kt in the axial groove portion of the rotor blade groove is 2.03. Moreover, it is confirmed that the stress concentration coefficient Kt in the circumferential groove portion of the rotor blade groove is smaller than that in FIG. 9B showing a case where the stress concentration coefficient is simulated for the rotor blade groove of the conventional rotor blade support structure.

Thus, the flow of the stress in the rotor disc circumferential direction which conventionally concentrates in the circumferential groove portion of the rotor blade groove can be distributed to the circumferential groove portions 13, 13 and the axial groove portion 15 of the rotor blade groove 10 and be alleviated by providing the axial groove portion 15 in the rotor blade groove 10.

As described above, in the rotor blade support structure of the embodiment, the axial groove portion 15 is provided in the center portion of the bottom portion 14 of the rotor blade groove 10 in the rotor disc circumferential direction, in each of the end surface portions 1*a*, 1*b* of the rotor disc 1 in the rotor blade groove 10 and this has the following effects. The tensile stress in the rotor disc circumferential direction is generated in layers in the rotor disc 1 by the transient thermal stress and the flow of the stress in the rotor circumferential direction which conventionally concentrates in the circumferential groove portion of the rotor blade groove can be distributed to the circumferential groove portions 13, 13 and the axial groove portion 15 of the rotor blade groove 10 and be alleviated. Thus, the stress concentration in the circumferential groove portions 13, 13 in the rotor blade groove 10 is suppressed. Moreover, there is a need to only provide the axial groove portion 15 in the rotor blade groove 10. Since the axial groove portion 15 can be easily formed by machining and there is no need to change the shapes of the circumferential groove portions in the rotor blade groove, an increase in manufacturing cost can be suppressed. Furthermore, the axial groove portion can be provided in the rotor blade groove of the rotor disc not only in a case of newly installing a turbine but also in maintenance.

INDUSTRIAL APPLICABILITY

The present invention is the blade support structure and can suppress the stress concentration in the circumferential groove portion in the rotor blade groove in which the rotor blade is embedded, with an increase in manufacturing cost suppressed. Accordingly, the present invention can be used beneficially in the power generating industry which uses tribunes.

EXPLANATION OF REFERENCE NUMERALS

1 rotor disc
1*a*, 1*b* end surface portion
10 rotor blade groove
13 circumferential groove portion
14 bottom portion
15 Axial Groove Portion (Relief Groove Portion)
30 Rotor Blade
31 Blade Root
32 Platform
33 Blade Portion
d Size of Axial Groove Portion (Relief Groove Portion) in Axial Direction
2W Size of Rotor Blade Groove in Rotor Disc Circumferential Direction 2*w'* Size of Axial Groove Portion (Relief Groove Portion) in Rotor Disc Circumferential Direction θ Relief Angle

The invention claimed is:

1. A rotor blade support structure in which a rotor blade is embedded in a rotor blade groove provided in a rotor disc, the rotor blade groove comprising:

a circumferential groove portion in a bottom portion of the rotor blade groove, the circumferential groove portion extending in a rotor disc circumferential direction beyond a portion above the bottom portion; and a radial groove portion which has an arc-shaped end, is provided in a center portion in the rotor disc circumferential direction, extends in a rotor disc radial direction, and has a shape which includes a corner portion formed by the bottom portion of the rotor blade groove and an end surface portion of the rotor disc and in which only part of the bottom portion and the end surface portion is cut away, in such a way as to distribute stress generated by transient thermal stress together with the circumferential groove portion.

2. The rotor blade support structure according to claim 1, wherein w'/W is within a range of 0.49 to 1.0, where 2W represents a size of the bottom portion of the rotor blade groove in the rotor disc circumferential direction and 2*w'* represents the size of the radial groove portion in the rotor disc circumferential direction.

3. The rotor blade support structure according to claim 2, wherein an angle of the radial groove portion with respect to an end surface direction of the rotor disc in the bottom portion of the rotor blade groove is within a range of 20° to 50°.

4. The rotor blade support structure according to claim 3, wherein d/w' is within a range of 1.0 to 1.4, where d represents a size of the radial groove portion in the rotor disc radial direction.

5. The rotor blade support structure according to claim 1, further comprising:

a plurality rotor blade grooves;

wherein a plurality of the radial groove portions are formed in each of the plurality of rotor blade grooves.

6. The rotor blade support structure according to claim 1, wherein the rotor disc includes end surface portions, and the radial groove portion is formed in each of the end surface portions.

* * * * *